US007594580B2

(12) United States Patent
Roraback, Jr.

(10) Patent No.: US 7,594,580 B2
(45) Date of Patent: Sep. 29, 2009

(54) LOCK PIN DECODING APPARATUS

(75) Inventor: Gerald G. Roraback, Jr., Watertown, CT (US)

(73) Assignee: Lab Security Systems Corporation, Bristol, CT (US)

( * ) Notice: Subject to any disclaimer, the term of this patent is extended or adjusted under 35 U.S.C. 154(b) by 582 days.

(21) Appl. No.: 11/342,399

(22) Filed: Jan. 30, 2006

(65) Prior Publication Data

US 2007/0175253 A1 Aug. 2, 2007

(51) Int. Cl.
*B07C 7/04* (2006.01)

(52) U.S. Cl. ..... 209/614; 209/702; 209/703; 33/501; 33/501.08

(58) Field of Classification Search ..... 209/614, 209/702, 703; 70/376, 378, 384, 493; 33/501.08, 33/501
See application file for complete search history.

(56) References Cited

U.S. PATENT DOCUMENTS 2,791,840 A * 5/1957 Harwell ..... 33/540
3,499,302 A 3/1970 Spain et al. ..... 70/364
3,722,240 A 3/1973 Spain et al. ..... 70/364 A
4,635,455 A 1/1987 Oliver ..... 70/364 A
5,987,946 A * 11/1999 Watts ..... 70/394
2007/0175253 A1 * 8/2007 Roraback, Jr. ..... 70/494

* cited by examiner

*Primary Examiner*—Patrick H Mackey
*Assistant Examiner*—Terrell H Matthews
(74) *Attorney, Agent, or Firm*—St. Onge Steward Johnston & Reens LLC

(57) ABSTRACT

A device and method to sort high security lock pins to characterize their length, wedge direction, and slot position comprises a lock pin decoding body containing lock pin cavities that receive high security lock pins and orient them in a uniform way by fitting a tab on the upper end of the lock pins in a notch, thereby revealing whether the lock pins have a slot positioned in the "left", "center" or "right" positions, which can be read from indicia on the lock pin decoding body, and further revealing if the lock pins have a "fore" or "aft" facing wedge, which can also be read from indicia on the lock pin decoding body.

10 Claims, 7 Drawing Sheets

LOCK PIN DECODING APPARATUS

FIELD OF THE INVENTION

The present invention relates to lock security pins, and, more particularly, to identifying and sorting security pins.

BACKGROUND OF THE INVENTION

High security locks that are designed to be pick proof and drill proof utilize specialized lock pins. FIG. 1 illustrates an example of a high security lock 002 of the type sold by Medeco Security Locks, Inc. and which is described in U.S. Pat. Nos. 3,499,302; 3,722,240; and 4,635,455; the disclosures of which are hereby incorporated by reference. Lock 002 is composed of a case 008, a cylinder 002, and tumbler components 010. Cylinder 002 fits into case 008 and comprises key hole 004, tumbler holes 018 and latch bar 006. Case 008 receives cylinder 002 into cylinder hole 017 and receives tumbler components 010 into tumbler holes 016. Tumbler components 010 may comprise of spring 012, top pin 014, and security pin 020. Security pins 020 can utilize three distinctive features to inhibit a lock from being picked. These aspects are pin length, wedge orientation, and slot position.

FIGS. 2A-2E; 3A and 4A-4B show alternative embodiments of security pins used in lock 002. Security pin 020 in FIGS. 2A-2E has a top part 024, a bottom part 021, a long side 025 and a short side 026. Tab 029 is located at the top end of the security pin extending from top part 024. The distance from the top part 024 to the bottom part 021 is considered the pin length. Security pins typically come in six different lengths and are identified as being size 1-6. As the security pin 020 transitions from short side 026 to long side 025 through top part 024, a wedge 022 is formed. Wedge 022 has a long wedge face 027 and a short wedge face 028. Wedge 022 can be oriented in the fore direction or the aft direction, depending on whether bottom part 021 forms a point to the left or right of tab 029. Generally, a wedge 022 which has a bottom part 021 forming a point to the right of tab 029 is considered an "aft" wedge or "aft facing" wedge because the wedge is facing to the left (rear); a wedge 022 which has a bottom part 021 forming a point to the left of tab 029 is considered an "fore" wedge or "fore facing" wedge because the wedge is facing to the right (front).

Formed within security pin 020 and transitioning from the top part 024 end to the bottom part 022 end is a slot 023. Slot 023 can be positioned to the left, the center, or the right. Slot 023 is positioned to the left when slot 023 lies in a position greater than 180 degrees from the tab 029 in a clockwise direction. Slot 023 is positioned to the right when slot 023 lies in a position less than 180 degrees from the tab 029 in a clockwise direction. Slot 023 is positioned to the center when slot 023 lies in a position approximately 180 degrees from the tab 029.

Security pin 020 in FIGS. 2A-2E is a high security pin of length 6, with an aft facing wedge and a right slot. In contrast, security pin 020' in FIG. 3A is a high security pin of length 6, with an aft wedge and a center slot. Security pin 20" in FIGS. 4A-4B is a shorter pin, of length 3, with a fore wedge and a left slot.

Security pins 020 thus can have six different lengths; two different wedge directions, and three different slot positions, yielding a total of 36 different combinations of characteristics, i.e. 36 different security pins. Since the pins are small, it is difficult to consistently and accurately discern all the characteristics with the naked eye. If such security pins are dropped on the floor or mixed together on a workbench they require a high degree of concentration by a skilled locksmith to sort them into their correct categories and correctly put them away with other pins of the same size. If they are not correctly sorted then they will cause problems. An inoperative lock (if a lock is inadvertently assembled with the wrong lock pin) is at minimum a problem for the locksmith who will have to disassemble and re-pin the lock, and potentially could be a security problem for the structure which now has an ineffective lock.

Furthermore, security pins of this type are not inexpensive, currently costing about $27 per 100 pins. A locksmith who drops a tray containing many bins of differently sized security pins cannot afford to throw them away, but also may not be able to afford the time needed to carefully to sort them out back into their proper bins.

What is needed is a device or method to discern the characteristics of a security pin, to decode them and/or to sort them. It would also be beneficial if the device or method could identify master pins, top pins, and security pins attributable to an individual key.

SUMMARY OF THE INVENTION

These and other objects are achieved by providing a pin sorter that discerns at least two characteristics of a security pin.

In one advantageous embodiment of the present invention, the pin sorter comprises a security pin cavity that is capable of providing a length measurement and a surface capable of providing a slot measurement. The surface can also be used to provide a wedge measurement.

The pin decoder can also incorporate pin cavities shaped to provide a wedge measurement on the surface and markings on the surface to indicate the orientation of the slot.

It is another aspect of this invention for the pin sorter to comprise up to 6 security pin cavities, sized to correspond to each possible security pin length, each shaped to support a security pin tab to aid in the orientation of the pin within the cavity.

The pin sorter can also provide cavities to measure master pins and top pins, and a key gauge.

It is yet another aspect of the present invention to provide a method for sorting security pins comprising placing a security pin in a cavity, identifying that the cavity corresponds to the security pin length, reading the wedge orientation within the cavity, and reading the slot orientation within the cavity.

Other objects of the invention and its particular features and advantages will become more apparent from consideration of the following drawings and accompanying description.

DETAILED DESCRIPTION OF THE INVENTION

Figure 1:
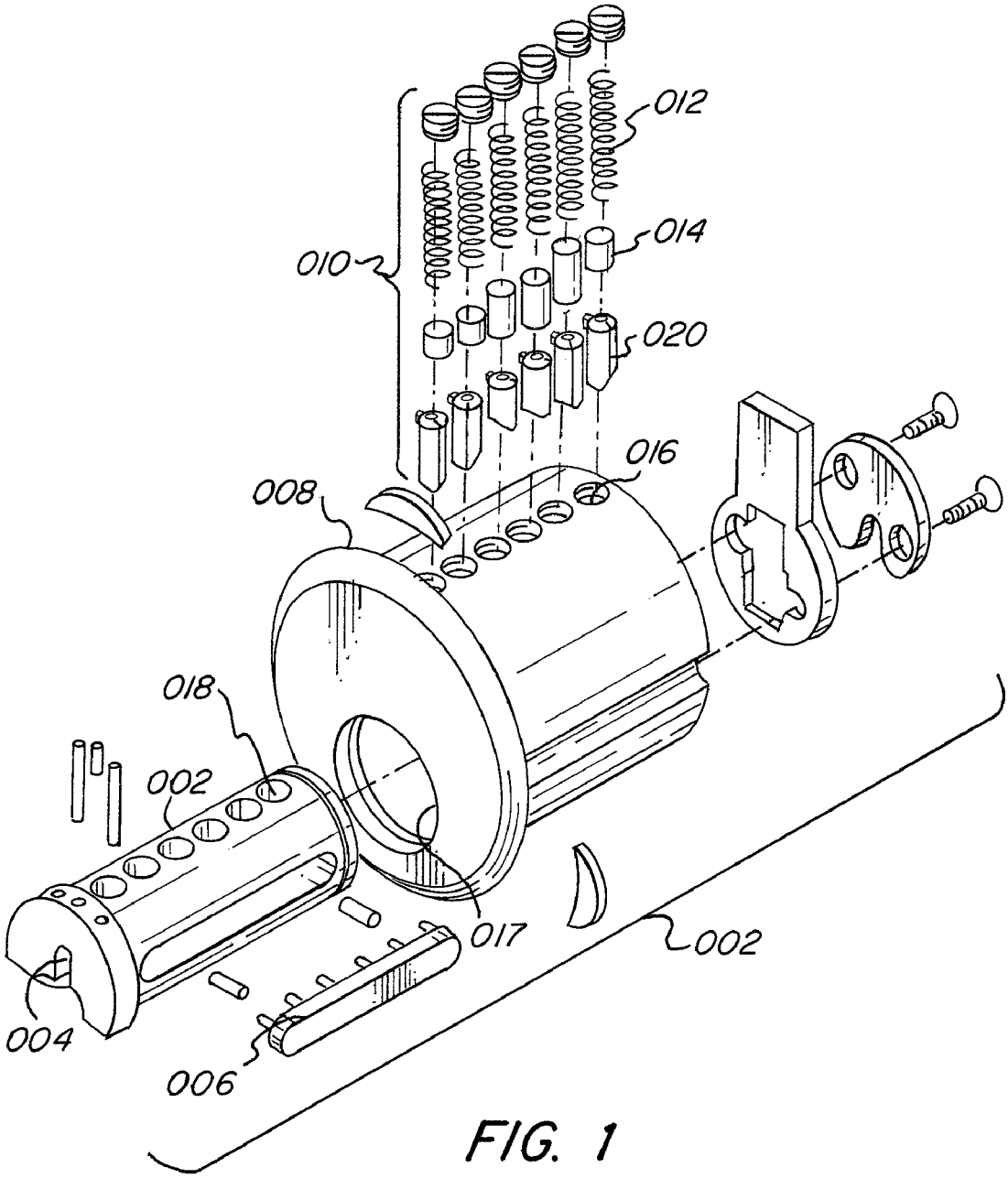
FIG. 1 ( PRIOR ART )
FIG. 1 is a perspective view of the components to a high security lock.
Figure 2A:
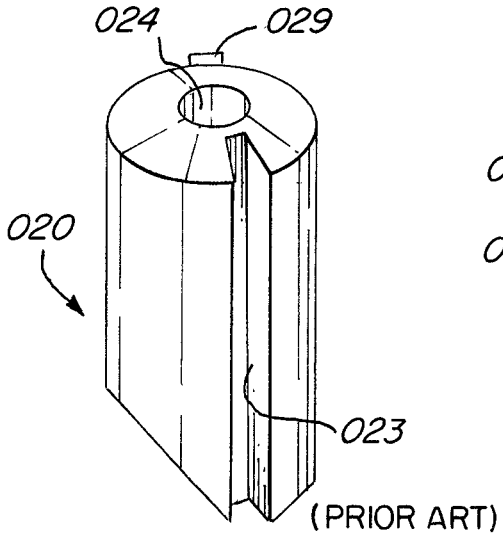
FIG. 2A is a top and front perspective view of a first embodiment of a high security pin.
Figure 2B:
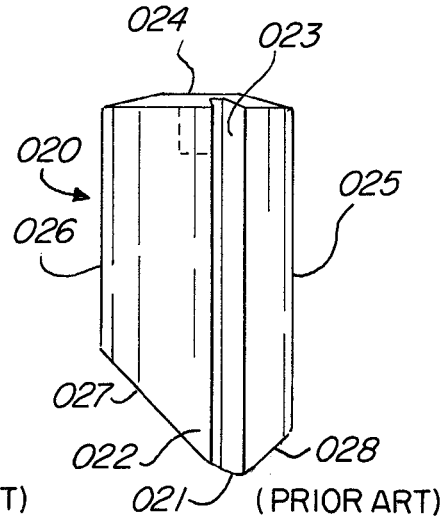
FIG. 2B is a front elevation view of the high security pin of FIG. 2A.
Figure 2C:
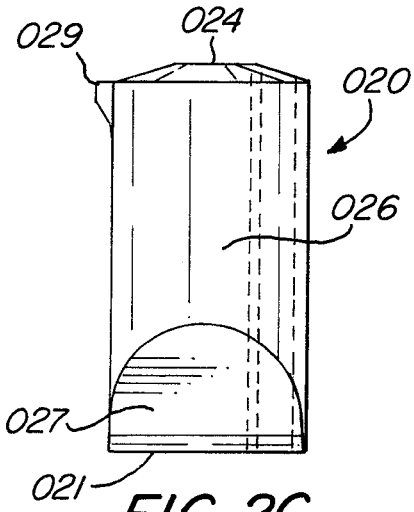
FIG. 2C (PRIOR ART)
FIG. 2C is a right side elevation view of the high security pin of FIG. 2A.
Figure 2D:
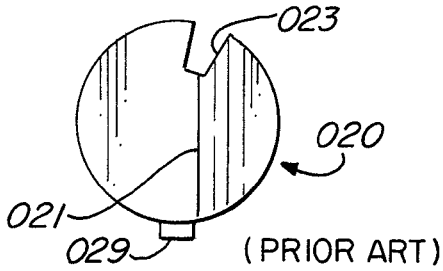
FIG. 2D is a bottom plan view of the high security pin of FIG. 2A.
Figure 2E:
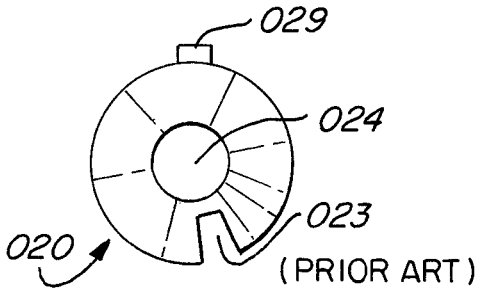
FIG. 2E is a top plan view of the high security pin of FIG. 2A.
Figure 3A:
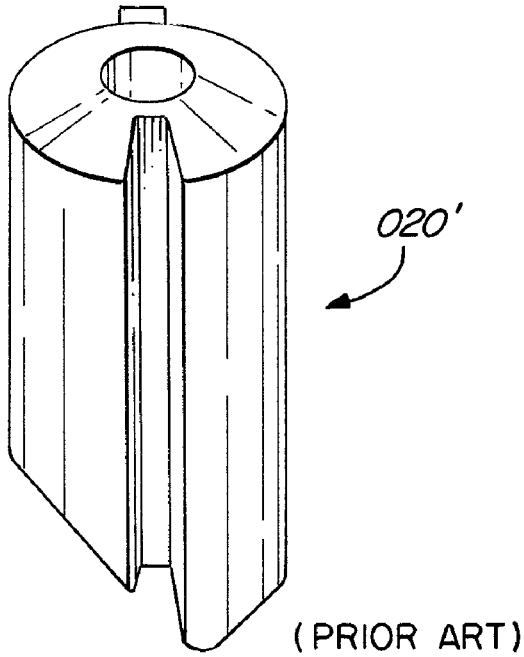
FIG. 3A is a top and front perspective view of a second embodiment of a high security pin.
Figure 4A:
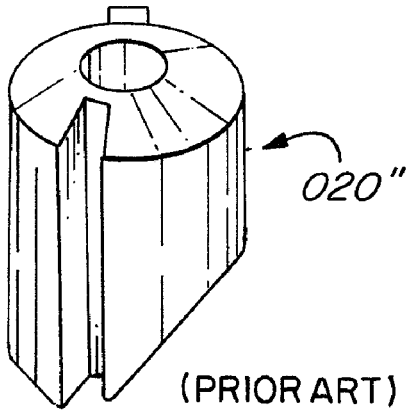
FIG. 4A is a top and front perspective view of a third embodiment of a high security pin.
Figure 4B:
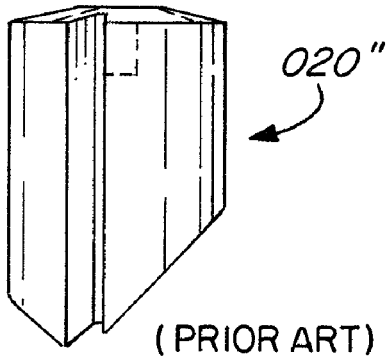
FIG. 4B is a front elevation of the high security pin of FIG. 4A.
Figure 5:
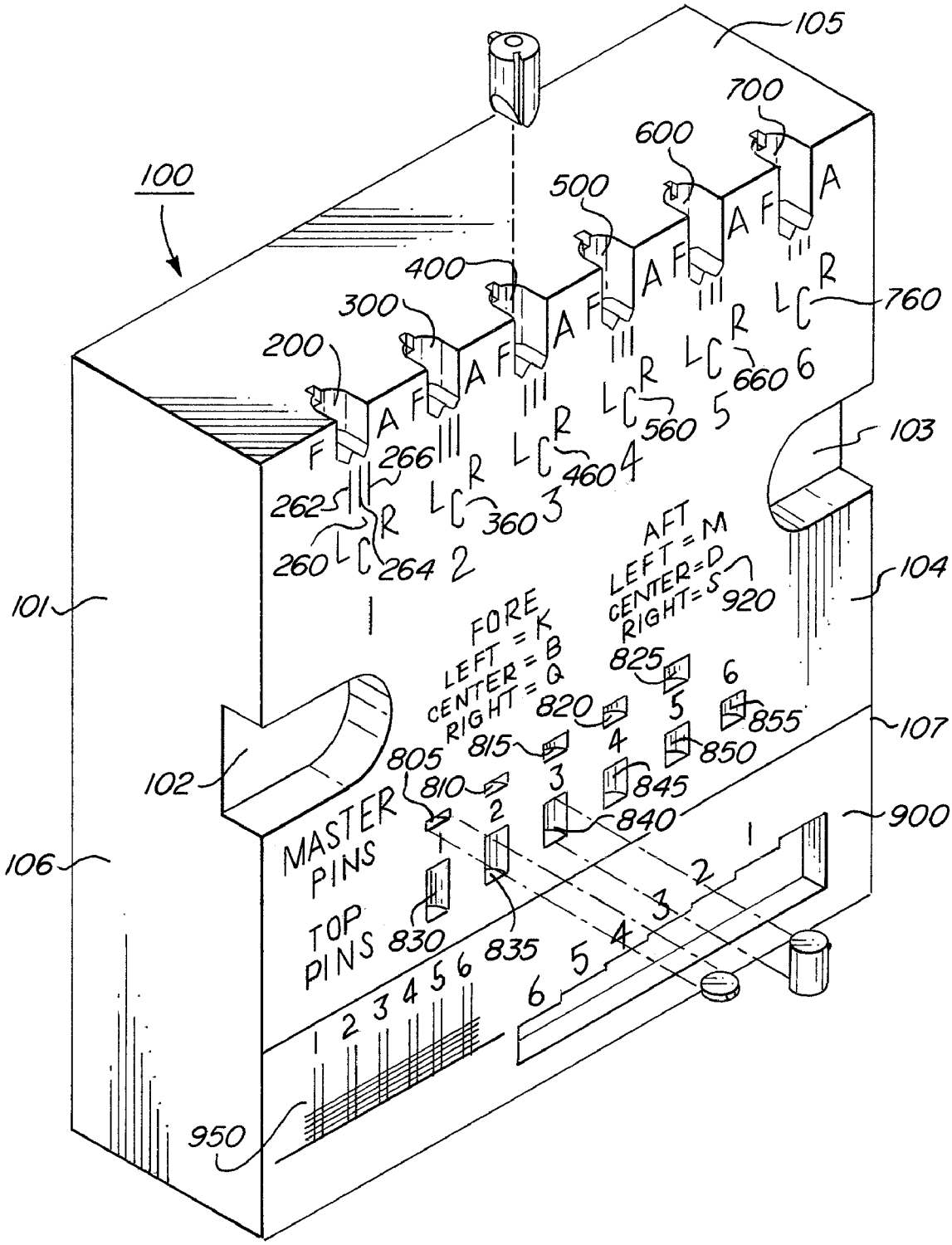
FIG. 5 is a front, top and right side perspective view of an embodiment of a Lock Pin Decoding Apparatus in accordance with the invention.
Figure 6A:
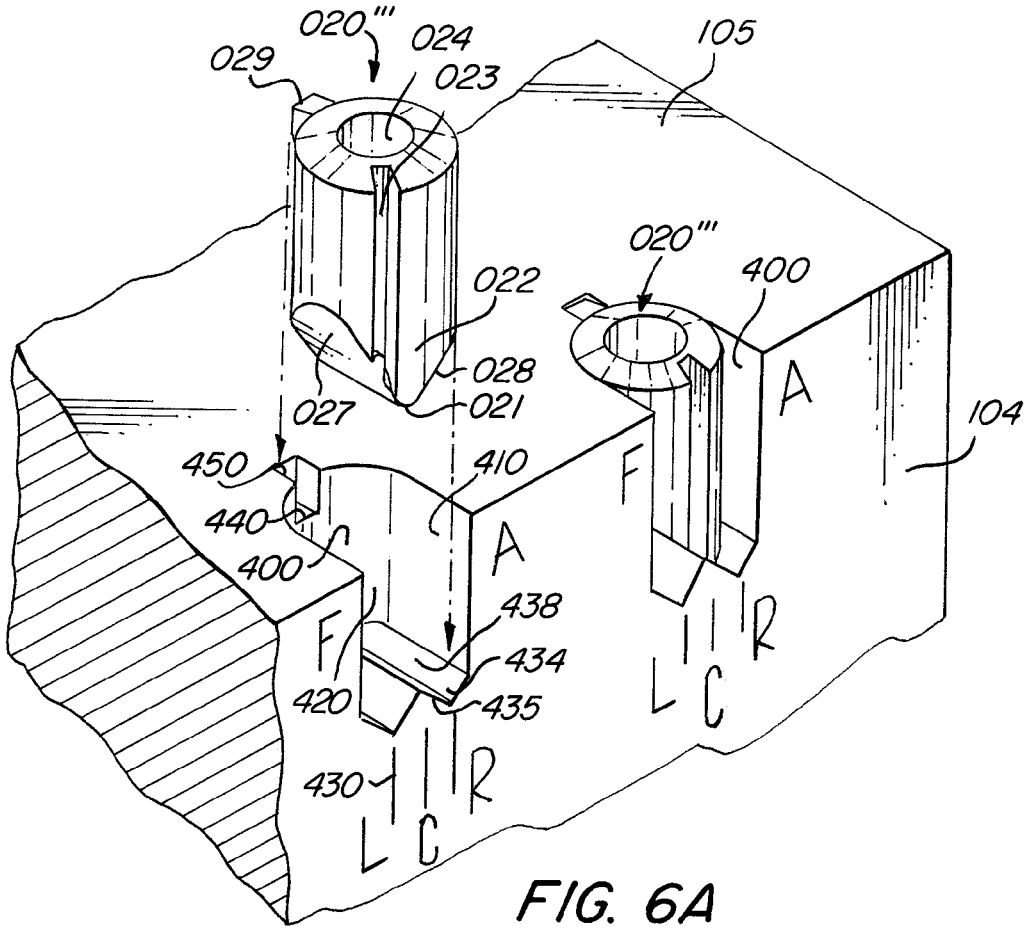
FIG. 6A is a top and front perspective partial view of a security pin being inserted into a security pin cavity in the Lock Pin Decoding Apparatus of FIG. 5.
Figure 6B:
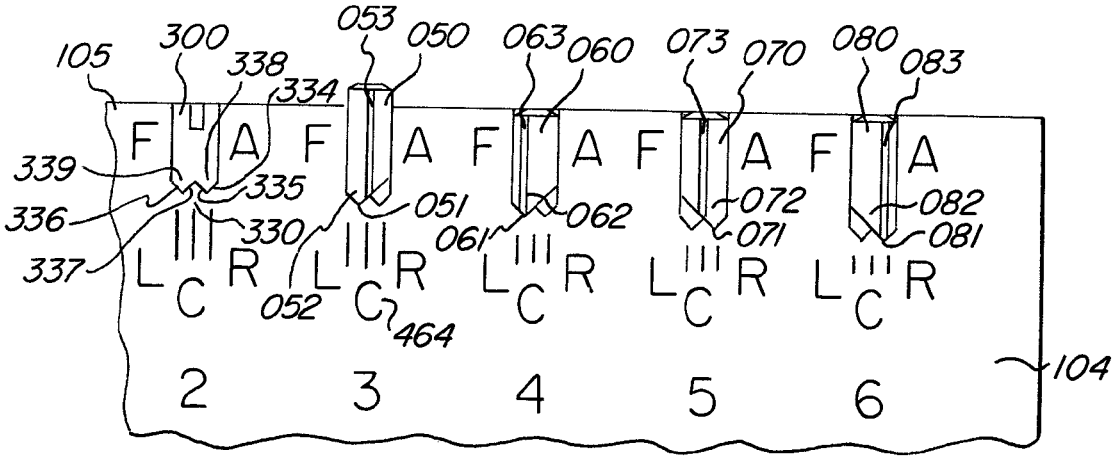
FIG. 6B is a front elevation partial view of security pins of different sizes inserted into security pin cavities in the Lock Pin Decoding Apparatus of FIG. 5.
Figure 7:
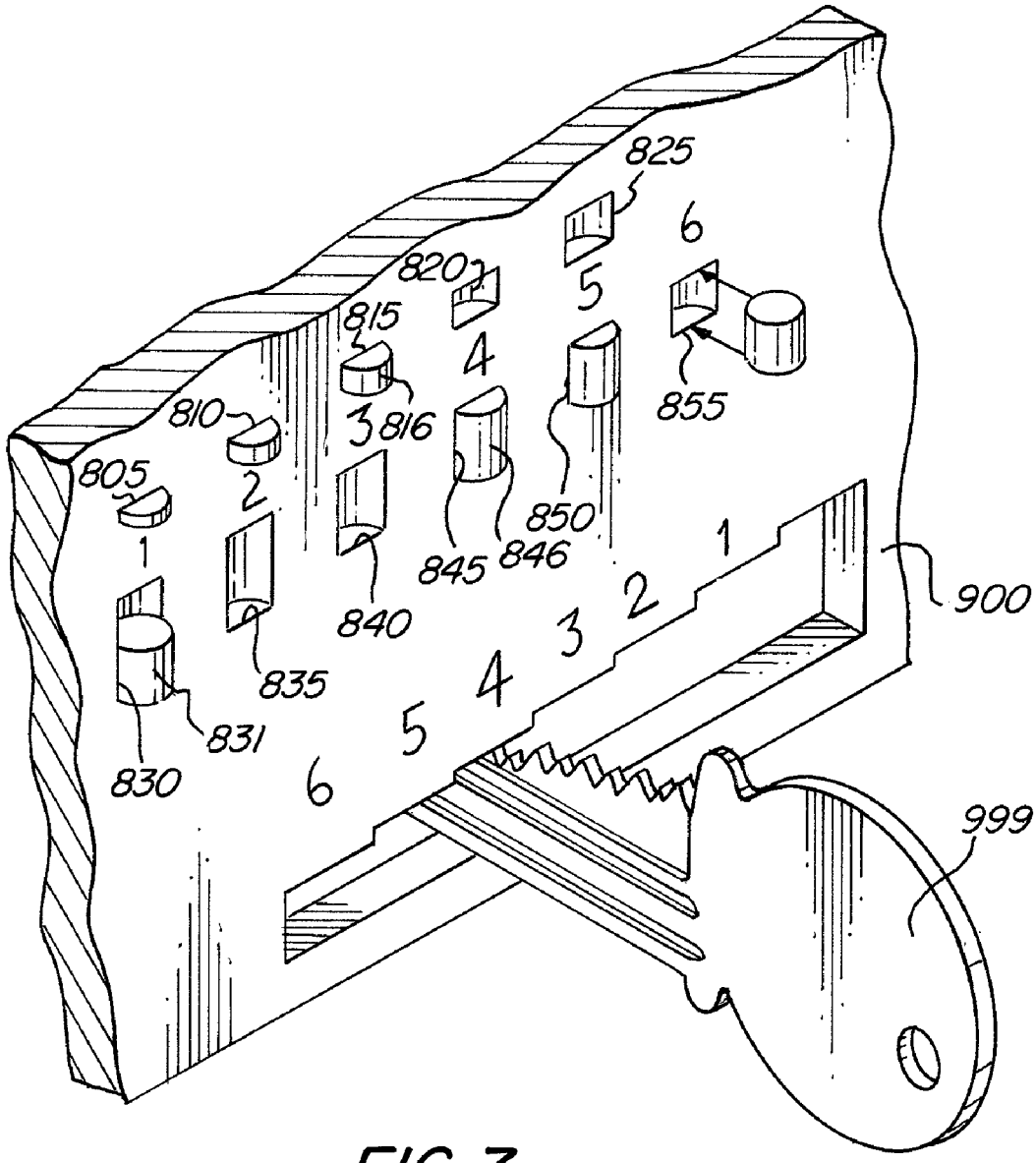
FIG. 7 is a front perspective partial view of master pins and top pins in their respective cavities, and a key inserted into a key gauge cavity, in the Lock Pin Decoding Apparatus of FIG. 5.

An embodiment of a pin decoder 100 is shown in FIGS. 5-7. Pin decoder 100 comprises a decoder body 101 with a first or front measurement surface 104, a second or top measurement surface 105, a left side 106 and a right side 107. Formed within the first measurement surface 104 and left side 106 is a first holder 102 which is a depression that helps a user to grip pin decoder 100 by the user's hand and fingers. Formed in the first measurement surface 104 and right side 107 is a second holder 103 which is a depression that enables the user to grip pin decoder 100. The finger grip depressions 102 and 103 are provided to reduce the chances of the user dropping the pin decoder 100 through sliding of the pin decoder 100 in the user's fingers.

A security pin is decoded and its characteristics determined using security pin cavities 200-700. Pin decoder 100 comprises a first security pin cavity 200, a second security pin cavity 300, a third security pin cavity 400, a fourth security pin cavity 500, a fifth security pin cavity 600, and a sixth security pin cavity 700. Each security pin cavity corresponds to a size 1-6 security pin length respectively. Each security pin cavity is open at its top and front ends.

Some of the aspects of each pin cavity will be discussed by way of example with third security pin cavity 400 shown in FIG. 6A. The third security pin cavity 400 is formed within both the first measurement surface 104 and second measurement surface 105. The formation of third security pin cavity 400 with second measurement surface 105 forms a first length measurement surface 470 and a second length measurement surface 475. The third security pin cavity 400 comprises a first cavity side 410, a second cavity side 420, a third cavity side 430, and a fourth cavity side 440. The first 410 and second 420 cavity sides form surfaces which intersect with and extend away from first measurement surface 104 and second measurement surface 105. The third cavity side 430 forms a surface that intersects and extends away from first measurement surface 104. The fourth cavity side 440 forms a surface that intersects and extends away from second measurement surface 105. The first 410, second 420, and third 430 cavity sides are surfaces that are not parallel to first measurement surface 104. The fourth cavity side 440 forms a surface, a portion of which is parallel to first measurement surface 104. Fourth cavity side 440 has a notch 450 that is located at the rear upper end of cavity 400 and which is adapted to receive a security pin tab such as tab 029 of security pin 020.

The aspects of a third cavity side will be discussed further by way of example with a third side 330 to security pin cavity 300 shown in FIG. 6B. The third side 330 can be shaped to correspond to an appropriate wedge orientation. This shape incorporates a first aft wedge side 334, a second aft wedge side 335, a first fore wedge side 336, and a second fore wedge side 337. The intersection of first aft wedge side 334 and second aft wedge side 335 forms an aft wedge cavity 338, which is capable of receiving a security pin with an aft wedge. The intersection of first fore wedge side 336 and second fore wedge side 337 form a fore wedge cavity 339, which is capable of receiving a security pin with a fore wedge. Adjacent to each wedge cavity are indicia or markings that indicates if the wedge is a fore or aft wedge. The wedge direction is indicated by the letters "A" (for "aft") or "F" (for "fore") adjacent the side of the pin cavity.

As seen in FIG. 5, adjacent to the fourth cavity side of each security pin cavity are slot markings 260, 360, 460, 560, 660 and 760. The nature of these slot markings will be discussed further by way of example with security pin cavity 200 and slot markings 260. Slot markings 260 comprise "L" as a left slot marking 262, "C" as a center slot marking 264, and "R" as a right slot marking 266. When a pin is properly inserted a slot marking should approximately correspond to the orientation of the slot formed in the security pin.

Pin decoder 100 can also be used to decode and characterize other types of lock pins besides high security lock pins. Pin decoder 100 is shown in FIGS. 5 and 7 as providing measurement cavities for master pins. Master pins are an extra lock pin sometimes used in locks to permit entrance using a master key in addition to the lock-specific key. As seen in FIGS. 5 and 7, pin decoder 100 comprises a first master pin cavity 805, a second master pin cavity 810, a third master pin cavity 815, a fourth master pin cavity 820, and a fifth master pin cavity 825. As described with the security pins above, each cavity is sized to correspond to a particular master pin length.

Pin decoder 100 is also shown as providing measurement cavities to decode and characterize top pins. Top pins mechanically inhibit a lock from being turned unless they are displaced by a proper key. As seen in FIGS. 5 and 7, pin decoder 100 comprises a first top pin cavity 830, a second top pin cavity 835, a third top pin cavity 840, a fourth top pin cavity 845, a fifth top pin cavity 850, and a sixth top pin cavity 855. As described with the master pins above, each cavity is sized to correspond to a particular top pin length.

Finally, pin decoder 100 is shown as providing a key gauge. The key gauge is used to identify the pins that are housed in a particular lock by taking measurements from a particular key. Here the key gauge provides cavity 950, in which a key is inserted, to make pin length and slot orientation measurements. The key gauge further comprises markings 950 to provide a wedge measurement.

FIGS. 6A and 6B demonstrate the method in which pin decoder 200 is used to characterize a security pin and to identify each of its variables. In FIG. 6A security pin 020''' is placed into security pin cavity 400. If the pin 020''' is of appropriate length for the pin cavity, the tab 029 will be received by notch 450. Further, the top part 024 will be approximately planar with second measurement surface 105. By these indications, the user determines that pin 020''' has a length that corresponds to the length of pin cavity 400 and is sized as pin length 4. The pin length is determined by reading the size indication "4" applied to the first measurement surface 104 below pin cavity 400, as seen in FIGS. 5 and 6B.

Tab 029 is seated in notch 450 such that slot 023 is on the forward facing half of the security pin 020. Top part 024 faces in the same direction as second measurement face 105. Bottom part 021 should come into contact with third cavity surface 430. In the example in FIG. 6A, long wedge face 027 becomes flush with second aft wedge side 435 and short wedge face 028 becomes flush with first aft wedge side 434. By these indications, the user determines that pin 020''' has an aft wedge 022. The wedge direction is determined by reading the letter "A" (for "aft") or "F" (for "fore") adjacent the side of the pin cavity which receives both the short and long wedge faces 028 and 027. In FIG. 6A, the letter "A" is applied to the first measurement surface 104 adjacent the aft wedge cavity 438 on the side of the pin cavity 400 which receives both the short and long wedge faces 028 and 027. Thus, pin 020''' is decoded and characterized as having an "aft" wedge (e.g. an aft facing wedge surface).

Further, the position of slot 023 is characterized when the pin 020''' is positioned in pin cavity 400 with tab 029 seated in notch 450. The slot 023 is aligned with one of three position indicators, the letters "L", "C" or "R" applied to the first measurement surface 104 below the pin cavity 400. The slot position is determined by reading the letter "L" (for "left") or "C" (for "center") or "R" (for "right") located below the slot 023. Thus, pin 020''' is decoded and characterized as having a left slot.

FIG. 6B shows additional examples in which security pins 050-080 are measured using pin decoder 100. As described above, the security pins are inserted into security pin cavities in pin decoder 100.

FIG. 6B shows security pin 050 being inserted into pin cavity 400. Wedge 052 is received by fore wedge cavity 439 adjacent the letter "F" showing that this pin has a fore wedge. Slot 053 of pin 050 aligns with center slot marking "C" shown at 464 showing that this pin has a center slot orientation. However, top part 054 of pin 050 protrudes beyond second measurement surface 105. This demonstrates that pin 050 is not a size three pin and must be inserted into another measurement cavity in order to determine the pin length.

FIG. 6B also shows three pins 060, 070 and 080 that are correctly identified for length, wedge orientation and slot orientation. Pin 60 is shown to be a size 4 pin with a fore wedge and a left slot. Pin 70 is shown to be a size 5 pin with an aft wedge and a center slot. Finally, Pin 80 is shown to be a size 6 pin with an aft wedge and a right slot.

Once a security lock pin is decoded as "fore" or "aft" and "left", "center" or "right", a further bin coding or O.E.M. part or size coding may be provided as in the indicia 920 shown in FIG. 5, indicating that "fore" "left" is coded as size "K"; "fore" "center" is size "B"; "fore" right" is size "Q", "aft" "left" is size "M"; "aft" "center" is size "D"; "aft" right" is size "S".

Other components of pin decoder 300 are utilized in a much simpler fashion. As shown in FIG. 7, master pins and top pins are identified by matching each pin with the correctly sized cavities 805-825 and 830-855 respectively. Cavities 805-825 correspond to size 1-5 master pins respectively. Cavities 830-855 correspond to size 1-6 top pins respectively. The size markings are applied to the first measurement surface 104 adjacent the size cavity to which the size marking applies. A master pin or top pin should fit into the appropriate master pin or top pin cavity without any looseness or play. FIG. 7 shows master pin 816 being identified as a size 3 master pin because the length of master pin 816 corresponds to the length of master pin cavity 815. FIG. 7 also shows top pin 831 being inserted into top pin cavity 830. As shown, top pin cavity 830 has a length greater than top pin 831. Since top pin 831 does not fit correctly within top pin cavity 830, then it is known that top pin 831 is not a size 1 top pin. Top pin 846 is shown inserted into top pin cavity 845 with a proper fit. Thus, top pin 846 is a size 4 top pin.

Finally, key gauge 900 is utilized to identity the pins housed in a particular lock by measuring a key 999. A pin that corresponds to a particular position on key 999 is identified by first inserting the key into cavity 900. When key 999 cannot be advanced any further to the left, then a pin length is identified for that particular position. The angle of the cut on the key can also be measured at that position to determine slot orientation. The wedge orientation is determined by aligning and comparing the key with markings 950.

In the preferred embodiment, pin decoder 100 is fabricated from steel and the various marking are made by engraving or etching the markings on the steel components. However, the pin decoder 100 could also be made of any other relatively low friction durable materials, including other metals such as aluminum or titanium, or various alloys, or polymeric materials such as ABS plastics, polyurethane, or other polymer materials. The indicia such as the illustrated lines and letters "L", "C", and "R" and "F" and :A" may be engraved in the surface of the pin decoder body 100, or printed, molded or applied by label.

Although the invention has been described with reference to a particular arrangement of parts, features, and the like, these are not intended to exhaust all possible arrangements or features, and indeed many modifications and variations will be ascertainable to those of skill in the art.

What is claimed is:

1. A lock pin sorting apparatus for characterizing high security lock pins having a variable length, wedge orientation, and slot position, comprising a body containing a plurality of lock pin cavities of different lengths, each said lock pin cavity being open at a top side thereof and having a notch located in a rear upper end thereof sized to received a lock pin tab and orient a lock pin in said cavity, and having at its lower end an aft wedge cavity and a fore wedge cavity.

2. The lock pin sorting apparatus of claim 1, further comprising indicia on the body indicating that a lock pin positioned in a lock pin cavity a left, center or right slot position.

3. The lock pin sorting apparatus of claim 2, further comprising indicia on the body indicating that a lock pin positioned in a lock pin cavity has an aft facing or fore facing wedge.

4. The lock pin sorting apparatus of claim 1, further comprising indicia on the body indicating at least of an aft facing or a fore facing wedge.

5. A lock pin sorting apparatus for characterizing high security lock pins having variable length, wedge orientation, and slot position, comprising a body containing a plurality of lock pin cavities of different lengths, each said lock pin cavity being open at a top and front side thereof and having a notch located in a rear upper end thereof sized to receive a lock pin tab and orient a lock pin in said cavity, and having at its lower end an aft wedge cavity and a fore wedge cavity;

indicia on the body indicating that a lock pin positioned in a lock pin cavity has a left, center or right slot position; and indicia on the body indicating that a lock pin positioned in a lock pin cavity has an aft facing or fore facing wedge.

6. A pin sorter comprising:

at least one security pin cavity sized to provide at least one length measurement; and a sorter surface providing one or more of a wedge orientation indication and a slot position indication; wherein a first security pin cavity is sized to provide a first length measurement; a second security pin cavity is sized to provide a second length measurement; a third security pin cavity is sized to provide a third length measurement; a fourth security pin cavity is sized to provide a for the length measurement; a fifth security pin cavity is sized to provide a fifth length measurement; and a sixth security pin cavity is sized to provide a sixth length measurement.

7. A lock pin sorting apparatus in accordance claims 1, 2, 3, 4, 5, or 6 further comprising one or more of: (a) a plurality of master pin sizing cavities; (b) a plurality of top pin sizing cavities; and (c) a key gauge sized to measure at least one pin length and at least one slot orientation of a key.

8. A method for sorting high security lock pins having variable length, wedge orientation, and slot position in a lock pin sorting apparatus, said apparatus including a body containing a plurality of lock pin cavities of different lengths, and indicia on the body indicating that a lock pin positioned in a lock pin cavity has a left, center or right slot position; and an aft facing or fore facing wedge, comprising the steps of:

placing a security lock pin in a lock pin cavity;

orienting the security lock pin in a normalized position;

reading a wedge orientation of said security lock pin within said cavity.

9. The method of claim 8, further comprising:

reading a slot position of said security lock pin within said cavity.

10. The method of claim 9, wherein said lock pin cavity in said body is provided with a notch, and said security lock pin is provided with a lock pin tab fittable in said notch, and wherein said step of orienting the security lock pin in a normalized position comprises seating said security lock pin in said lock pin cavity with said tab in said notch.

* * * * *